US006739979B2

(12) United States Patent
Tracy

(10) Patent No.: US 6,739,979 B2
(45) Date of Patent: May 25, 2004

(54) INTERACTIVE PLAY FOUNTAIN

(76) Inventor: Wyeth G. Tracy, 591 Albright Rd., Uxbridge, Ontario (CA), L9P 1R4

( * ) Notice: Subject to any disclaimer, the term of this patent is extended or adjusted under 35 U.S.C. 154(b) by 0 days.

(21) Appl. No.: 10/217,435

(22) Filed: Aug. 14, 2002

(65) Prior Publication Data

US 2003/0073505 A1 Apr. 17, 2003

(30) Foreign Application Priority Data

Oct. 17, 2001 (CA) ..... 2359155

(51) Int. Cl.[7] ..... A63G 31/00
(52) U.S. Cl. ..... 472/128; 472/117
(58) Field of Search ..... 472/116, 117, 472/128, 129, 137; 463/153; 4/488, 506, 507, 509

(56) References Cited

U.S. PATENT DOCUMENTS 3,363,268 A * 1/1968 Friedlander ..... 4/506
4,642,822 A * 2/1987 Tvengsberg ..... 4/488
5,503,597 A * 4/1996 Lochtefeld et al. ..... 472/128
5,820,471 A 10/1998 Briggs
5,820,472 A * 10/1998 Briggs ..... 472/128
6,062,983 A * 5/2000 Butsook ..... 472/117
6,319,139 B1 * 11/2001 Tracy ..... 472/128

* cited by examiner

*Primary Examiner*—Kien T. Nguyen

(57) ABSTRACT

An interactive fountain is suitable for installation in a spray or water park partially submerged in a swimming or wading pool. The fountain includes a body having an upper surface sized to support at least one user in a position standing or sitting thereon. The support structure may be formed in situ, or preformed off-site from precast materials. Two or more water nozzles are positioned within the support structure. The water nozzles are connected to a source of water under pressure, as well as to each other by means of a water conduit, whereby in use, water flows from the water source along the conduit and outwardly from each nozzle as a discharged jet, spray or other such stream of water. The water nozzles are configured to permit a user to partially or fully block or obstruct the nozzles, as for example, by the user putting his hand or foot over the nozzle such that when a nozzle is blocked, water is redirected to other non-obstructed water nozzles.

17 Claims, 4 Drawing Sheets

INTERACTIVE PLAY FOUNTAIN

SCOPE OF THE INVENTION

The present invention relates to an interactive play fountain, and more particularly a water fountain having a number of interconnected water nozzles which, when obstructed or blocked by a user's hand, foot or body, results in the redirection of water flow to other unobstructed nozzles, as discharged water streams of different intensity and/or pressure.

BACKGROUND OF THE INVENTION

Recreational installations at water parks or spray parks typically consist of one or more raised structures upon which water nozzles are mounted, so as to emit a discharge stream of water on the park users. U.S. Pat. No. 5,820,471 to Briggs discloses a conventional structure adapted for water park installation, and which includes as interactive play elements, tipping water buckets and user actuated water cannons.

While the play structure of Briggs permits users to interact or engage in participatory play with the individual water features, the size and overall cost of the Briggs water park structure makes it impractical for installation in smaller water parks or locations.

SUMMARY OF THE INVENTION

Accordingly, it is an object of the invention to provide an inexpensive water fountain which permits interactive water play by one or more users, whereby the users can alter the water spray pattern and/or intensity from the fountain.

Another object of the invention is to provide a prefabricated water fountain which includes a number of water nozzles, each adapted to emit a discharge stream therefrom, and which may be easily and inexpensively installed in a spray park, water park, wading or swimming pool or other suitable area.

Another object of the invention is to provide a robust interactive play structure, which may be easily manufactured and installed and which is adapted to support a number of users standing thereon.

A further object of the invention is to provide a mound-shaped fountain which is adapted for participatory play by one or more users, and may be placed in a number of possible locations, including without restriction upon the bottom of a wading pool projecting partially above the water surface, directly on the ground, or in a position raised above the ground as a part of a raised platform or play structure.

In furtherance of at least some of the foregoing objects, the present invention provides for an interactive fountain which is suitable for installation in a park, spray park or water park (hereinafter collectively and generally referred to as a water park) and/or partially submerged in a swimming or wading pool. The fountain includes a supporting structure or body having an upper surface sized to support at least one, and preferably multiple users in a position standing, sitting and/or lying thereon. The support structure may be formed in situ, as for example by pouring concrete or other castable materials into a prepared form, or from asphalt. Most preferably, however, the support structure is preformed off-site, as by way of non-limiting example, from a precast concrete fiberglass, elastomeric material, resins, plastics or other suitable castable materials. Two or more, and preferably at least four water nozzles are positioned within the support structure. The water nozzles are connected to a source of water under pressure, as well as to each other by means of a water conduit, whereby in use, water flows from the water source along the conduit and outwardly from each nozzle as a discharged jet, spray or other such stream of water.

The water nozzles are configured to permit a user to partially or fully block or obstruct the nozzles, as for example, by the user putting his hand or foot over the nozzle. When a nozzle is blocked, the flow of water is redirected from the blocked nozzle to one or more other non-obstructed water nozzles, flowing therefrom as discharge streams of increased intensity or pressure.

More preferably, the water nozzles and the water conduit providing the interconnection between the nozzles are recessed either flush within or beneath the upper surface of the fountain supporting structure, so as to not present protuberances which could otherwise injure a user.

The water fountain is adapted to be erected in a number of possible environments including without restriction on a platform raised above the ground, as for example, on an elevated surface of the type of play structure disclosed in U.S. Pat. No. 5,820,471 to Briggs. Where a preformed support structure is to be used, the fountain may be erected by placing the supporting structure directly upon a prepared concrete or asphalt slab, or any other such ground surface.

Most preferably, however, the supporting structure of the water fountain is provided as a generally dome-shaped fiberglass or elastomeric mound which is adapted for placement on the bottom of a wading or splash pool. In such a configuration, the mound preferably has a maximum height selected at between about 0.1 and 1.0 meters, so as to extend partially or wholly above the water surface of the pool. At least part or all of the upper surface of the fountain supporting structure may also be provided with a non-slip coating or embossed with a non-slip texture for enhanced safety.

The supporting structure itself may be formed into a fanciful shape, including without restriction, the shape of a fictitious or actual animal, as well as castles or other possible play structures or themes. If desired, other features may be incorporated into or provided on the upper surface of the support structure, such as play slides, water cannons, water bikes, or the like.

Accordingly, in one aspect the present invention resides in a waterpark amusement device including

- a support structure having upper surface sized to support at least one user standing or sitting thereon,
- a plurality of water nozzles, each disposed substantially in said support structure and open to an outlet orifice formed in said upper surface, said outlet orifice having a size and shape selected to enable said orifice to be substantially blocked by a user's hand or foot,
- a pressurized water source, and
- a water supply conduit providing fluid communication between said pressurized water source and said nozzles to permit water flow from said water source therealong and outwardly from said nozzles as a pressurized stream, the water supply conduit providing a fluid connection between said nozzles whereby the blockage of a first one of said nozzles by said user redirects said water flow to one or more other of said nozzles.

In another aspect, the present invention resides in an interactive waterpark fountain comprising,

- a pressurized water source,
- a support structure configured to support a plurality of users thereon, a plurality of water nozzles recessed substantially in said body, said nozzles each including an outlet orifice and being provided in fluid communication with said water source and each other, such that when said nozzles are unobstructed pressurized water flows from said water source and outwardly from the outlet orifice of each of said nozzle as a pressurized stream, and whereby the obstruction of the orifice of a first of said nozzle by a user to substantially prevent the flow of water therefrom redirects said water flow from one or more remaining unobstructed nozzles as a pressurized stream of greater intensity.

In a further aspect, the present invention resides in combination, a user interactive spray fountain, a wading pool for retaining a desired volume of water therein, and a pressurized water source, the spray fountain including, a support structure disposed in a partially submerged position in said pool and being configured to support a plurality of users standing thereon, a plurality of water nozzles disposed at least partially in said support structure, and a pressurized water source, a conduit providing fluid communication between said water source and said nozzles, said conduit further interconnecting said nozzles whereby when said nozzles are unobstructed water flows from said water source and outwardly from each of said nozzles as a discharge stream under a first pressure, and whereby the obstruction of one of said nozzles by a user's hand or foot to restrict the flow of water therefrom redirects said water flow to the remaining unobstructed nozzles as discharge streams of a second pressure greater than said first pressure.

BRIEF DESCRIPTION OF THE DRAWINGS

Reference will now be had to the following detailed description taken together with the accompanying drawings in which.

DETAILED DESCRIPTION OF THE PREFERRED EMBODIMENTS

Figure 1:
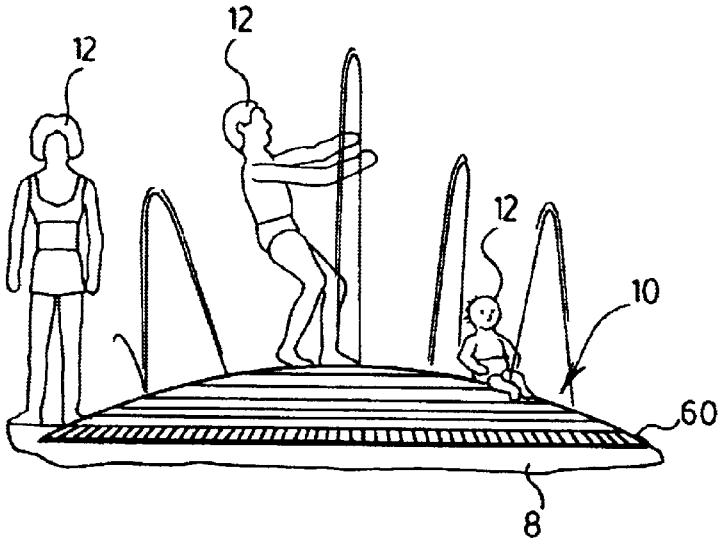
FIG. 1 shows a perspective view of an interactive water park fountain in accordance with a preferred embodiment of the invention installed on a concrete foundation.

FIG. 1 illustrates best a water park fountain 10 which has been erected on a concrete pad 8. As will be described, the fountain 10 is adapted for interactive and participatory water play with a number of individual users 12 standing, sitting or lying thereon. As shown best in FIG. 2, the fountain 10 includes a generally dome-shaped support structure or body 14, a water nozzle assembly 16, a water conduit assembly 18 for supplying water flow to the nozzle assembly 16 and a source of pressurized water 20.

Figure 2:
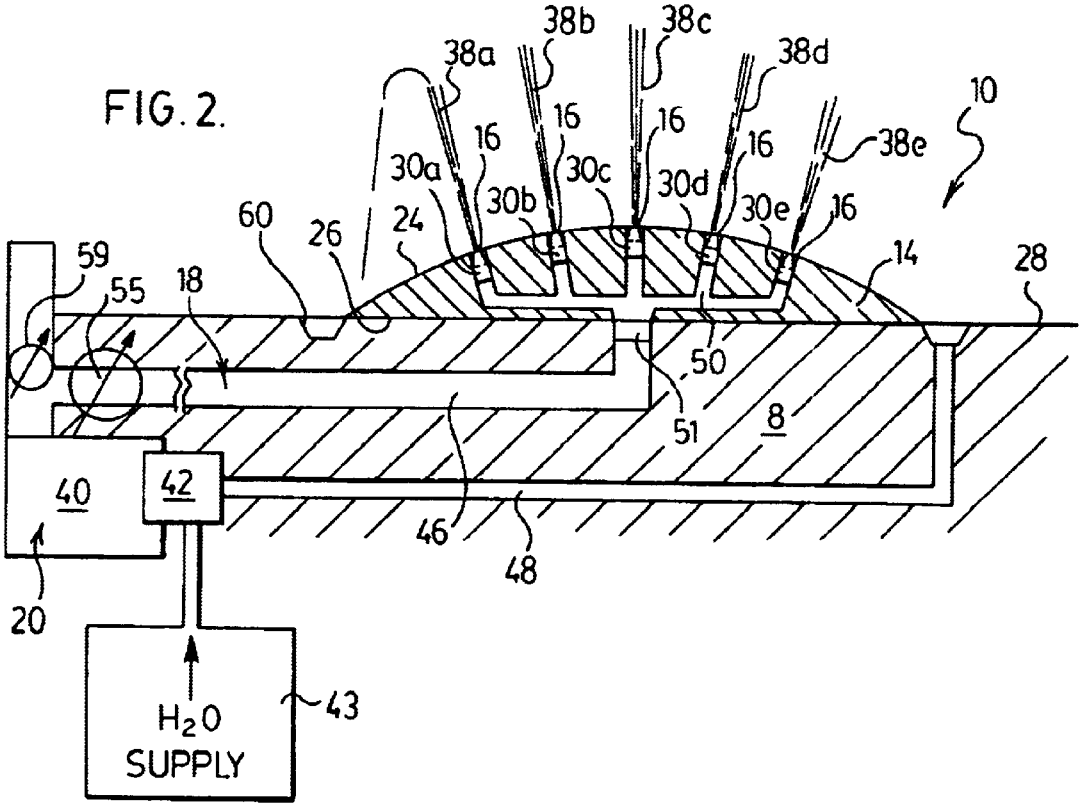
FIG. 2 shows a cross-sectional view of the fountain of FIG. 1.
Figure 4:
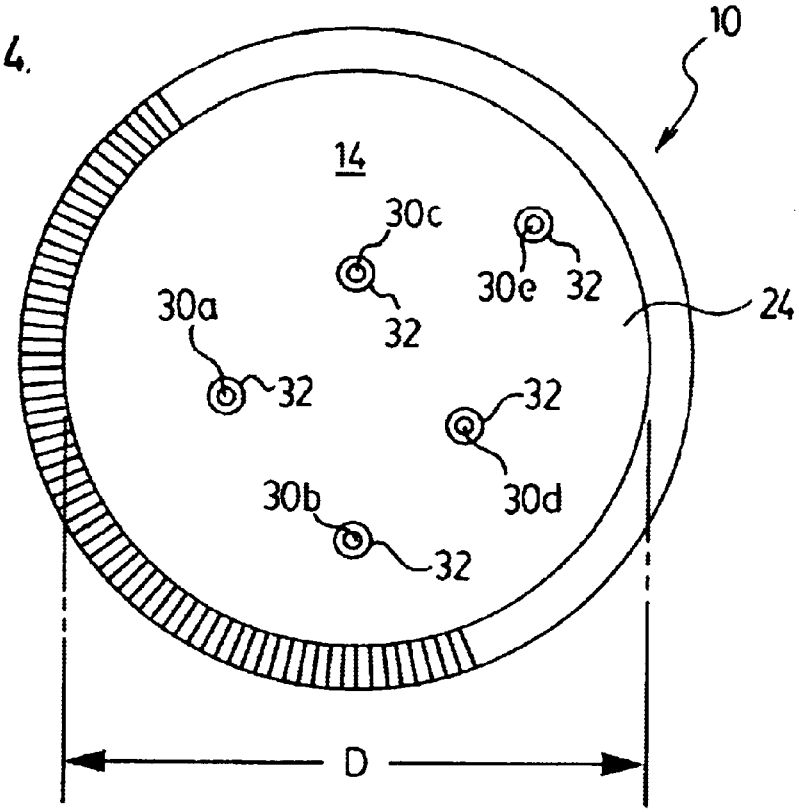
FIG. 4 illustrates a top view of the fountain of FIG. 1.

The body 14 of the fountain 10 is fabricated as a preformed generally dome-shaped mound made from fiberglass or an elastomeric material such as virgin rubber or recycled tire crumb. The body 14 may be solid or have a hollow interior and has a size and sufficient structural integrity to support the users 12 standing, sitting or lying on its upper surface 24. FIG. 2 illustrates the fountain body 14 as having a substantially flat base 26 being supported directly on the ground, resting on the surface 28 of the concrete slab 8. As shown in FIG. 4, the dome-shaped body 14 is generally circular in plan view and has a radial diameter D (FIG. 4) selected at between about 1 and 4 meters. Although the fountain body 14 could have a variety of different height configurations and/or contours, to minimize the potential that a user could slip on the upper surface 24, the surface 24 most preferably extends as a substantially spherical segment having a maximum height selected at between 0.1 and 1 meters between the base 26 and upper surface 24, and more preferably between about 0.1 and 0.3 meters.

Figure 3:
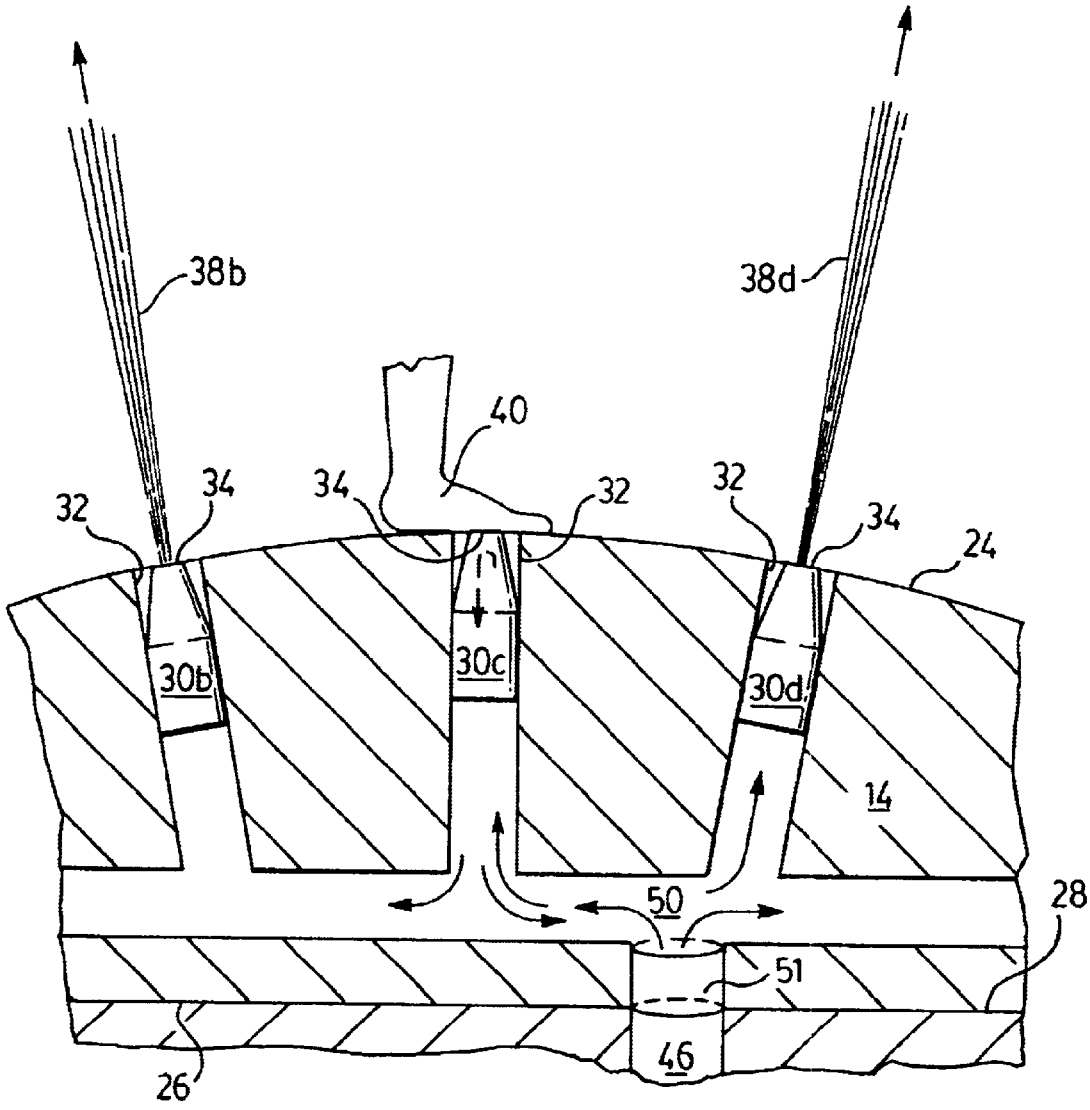
FIG. 3 shows an enlarged partial view of the fountain shown in FIG. 2, illustrating one manner of blocking a water nozzle to redirect the fountain spray.

As shown best in FIGS. 2 to 4, the nozzle assembly 16 consists of a number of nozzles 30*a*–30*e* which are spaced from each other at spaced locations about the body 14. As shown in FIG. 3, each of the nozzles 30 is located within a complementary sized bore 32 extending downwardly from the upper surface 24 of the support body 14. The nozzles 30 are positioned within the bore 32, so as to be recessed a marginal distance beneath the upper surface 24, so as not to present a protrusion which could otherwise injure a user 12 walking on the fountain body 14. As will be described, each of the nozzles 30*a*,30*b*,30*c*,30*d*,30*e* has an upwardly oriented outlet orifice 34 (FIG. 3), so as to direct a pressurized discharge stream of water 38*a*,38*b*,38*c*,38*d*,38*e* (FIG. 2) respectively therefrom in a generally upward orientation. The bore 32 and orifice 34 have a radial diameter and configuration selected to enable the orifice 34 to be blocked by a user's foot 70 (FIG. 3) or other body part to enable the user 12 to selectively prevent the discharge of water from one or more nozzles 30*a*–*e*. Although not essential, preferably the nozzles 30*a*,30*c*,30*e* are provided with a different configuration than the nozzles 30*b*,30*d* so as to discharge water streams 38*a*,38*c*,38*e* therefrom having visually differing spray patterns than streams 38*b*,38*d*.

The water conduit assembly 18 is shown best in FIG. 2 as including a main water supply pipe 46, a return water pipe 48 used in the recycling of spray water, an internal conduit pipe 50 housed within the fountain body 14 and which is connected to the main supply pipe 46, as well as providing fluid interconnection between each of the nozzles 30*a*–30*e*. The pressurized water source 20 consists of a water tank 40 (FIG. 2) and an electric water pump 42. Preferably, the pump 42 is also provided in selective fluid communication with a municipal water supply line 43. The pump 42 is adapted to pump water from the return pipe 48 and the supply line 43, as needed, into the tank 40 under pressure. Water thus flows under pressure from the tank 40 to the nozzles 30 under a sufficient pressure necessary to produce the desired discharge streams 38.

As shown best in FIG. 2, the main water supply pipe 46 is buried beneath the surface 28 of the concrete slab 8. The pipe 46 provides fluid communication between the water tank 40 and the internal conduit pipe 50, whereby water flows from the tank 40 and outwardly from any unobstructed nozzles 30*a*–*e* via the pipe 46 and 50 as a respective discharge stream 38*a*–38*e*. FIG. 2 shows the conduit pipe 50 as including a coupling 51 which projects downwardly below the bottom surface 26 of the fountain body 14 and which is adapted to link the internal conduit pipe 50 to the main water supply pipe 46.

Optionally, a main valve 55 (FIG. 2) may be provided to regulate water flow along the main supply pipe 46 to selectively permit or prevent water flow from the nozzles 30*a–e*. Alternately, the flow of water may be regulated by the selective activation or deactivation of the pump 42. More preferably, a pressure relief valve 59 is also provided in fluid communication with the conduit assembly 18. The pressure relief valve 59 is operable to divert water flow away from the nozzle assembly 16 when, for example, the water pressure in one or both of the pipes 46,50 exceeds a predetermined maximum threshold water pressure.

Although FIG. 2 illustrates the water pipe 50 as being provided within the support body 14, it is to be appreciated that in an alternate embodiment, the pipe 50 could be buried under or extend above the surface 28 of the slab 8.

As shown best in FIGS. 1 and 4, where the fountain body 14 is positioned directly on a concrete slab 8 or otherwise on the ground, a collection drain 60 is most preferably provided about the periphery of the fountain body 14. The collection drain 60 is adapted to collect and channel water discharged from the nozzles 30*a–e* into the return pipe 48. As indicated, the return pipe 48 is provided in fluid communication with the pump 42, whereby the electric pump 42 assists in recirculating water collected in the drain 60 to the water tank 40 under pressure. Although FIG. 4 illustrates the collection drain 60 as extending about the entire immediate peripheral surface of the fountain body 14, it is to be appreciated that other collection drain configurations are also possible. In an alternate arrangement, the fountain body 14 could be provided on a sloping grade, which itself is configured to channel any discharged water to a remote collection drain for recirculation.

In operation of the fountain 10, the valve 55 is opened and the electric pump 42 is activated to permit the pressurized water to flow from the tank 40. Water is supplied to the fountain 10 under pressure from a water tank 40 via a main supply pipe 46. Water flows under the desired pressure along the supply pipe 46 and into the internal pipe 50, and then outwardly from the orifice 34 of each unobstructed nozzle 30*a*,30*b*,30*c*,30*d*,30*e* as a respective pressurized discharge stream of water 38*a*,38*b*,38*c*,38*d*,38*e*.

As the water discharged from the nozzles 30*a–e* falls back onto the upper surface 24 of the body 14 or the surrounding concrete pad 8, it is directed into the peripheral drain 60. Water collected in the drain 60 is thus pumped via the electric pump 42 along the return pipe 48 and back to the water tank 40 for recirculation.

FIG. 3 shows best the fountain 10 as permitting interaction and participatory play with individual users 12. In particular, the construction of the fountain 10 permits the users 12 to vary the water spray and spray intensity by the selective blocking or obstruction of an orifice 34 of one or more of the nozzles 30*a–e*. By a user 12 moving his or her foot 70 (FIG. 3) to the position blocking nozzle 30*c*, the user may alter the pattern and intensity of the discharge streams 38. In particular, it is to be appreciated that upon the user 12 blocking the orifice 34 of water nozzle 30*c*, water flow is redirected along the fountain pipe 50 to any remaining unblocked nozzles 30*a*,30*b*,30*d*,30*e*. Furthermore, because water is supplied under pressure from the tank 40, the reduction in the number of operating discharge nozzles 30 which occurs when one or more of the nozzle orifices 34 are blocked results in the emission of discharge streams of increased pressure and/or intensity from the remaining unblocked nozzles 30*a*,30*b*,30*d*,30*e*. With the present invention, the users 12 may thus cover or uncover more or fewer nozzle orifices 34, depending upon spray intensity which is desired. Furthermore, by positioning the nozzles 30*a*,30*b*,30*c*,30*d*,30*e* about spaced locations across the upper surface 24 of the dome-shaped body 14, the users 12 may choose which nozzles 30 are to remain unblocked, effectively controlling the direction and/or location of the discharged water streams 38.

Although FIGS. 1 and 2 illustrate the fountain 10 as having a generally dome-shaped configuration and being positioned directly on the ground resting on a concrete pad 8, the invention is not so limited. It is to be appreciated that a fountain 10 having a substantially planar or other regular or irregular construction could also be used. As well, the fountain 10 could equally be mounted on an elevated surface spaced above the ground, such as on the play structure such as that disclosed in U.S. Pat. No. 5,820,471. Alternately, FIGS. 5 and 6 show another embodiment of the invention, in which like reference numerals are used to identify like components, and wherein the fountain 10 is adapted for placement in partially submerged orientation, erected on the bottom 72 of a swimming pool or wading pool 74.

Figure 5:
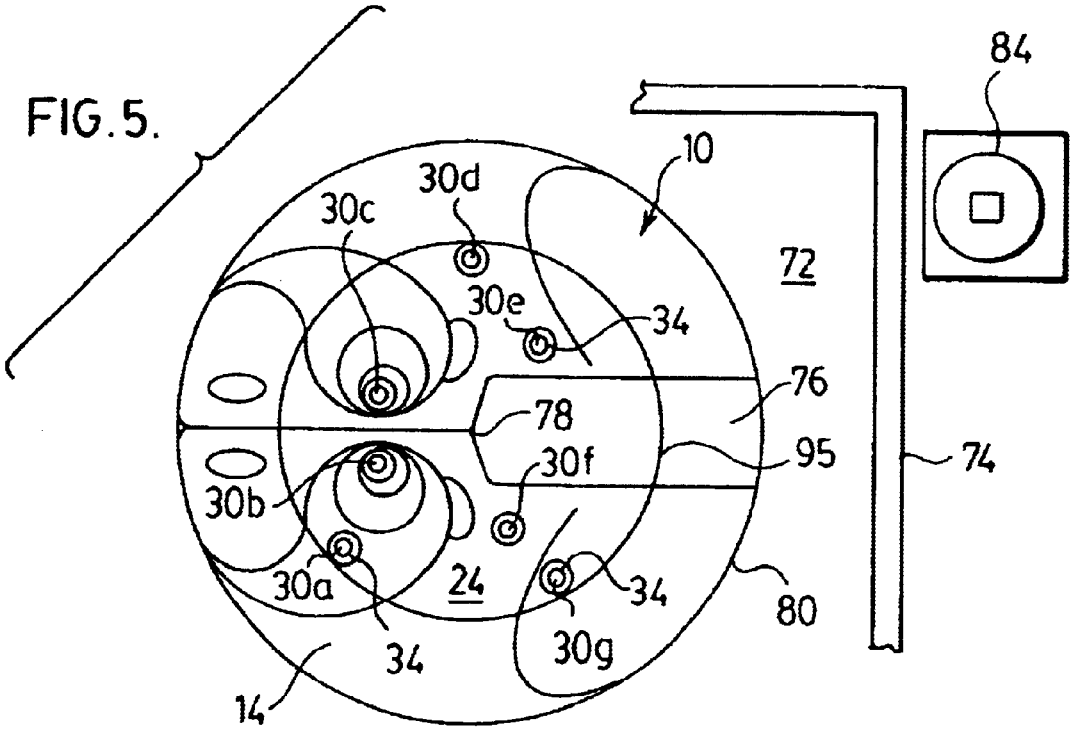
FIG. 5 illustrates a schematic top view of the water fountain in accordance with a second embodiment of the invention.
Figure 6:
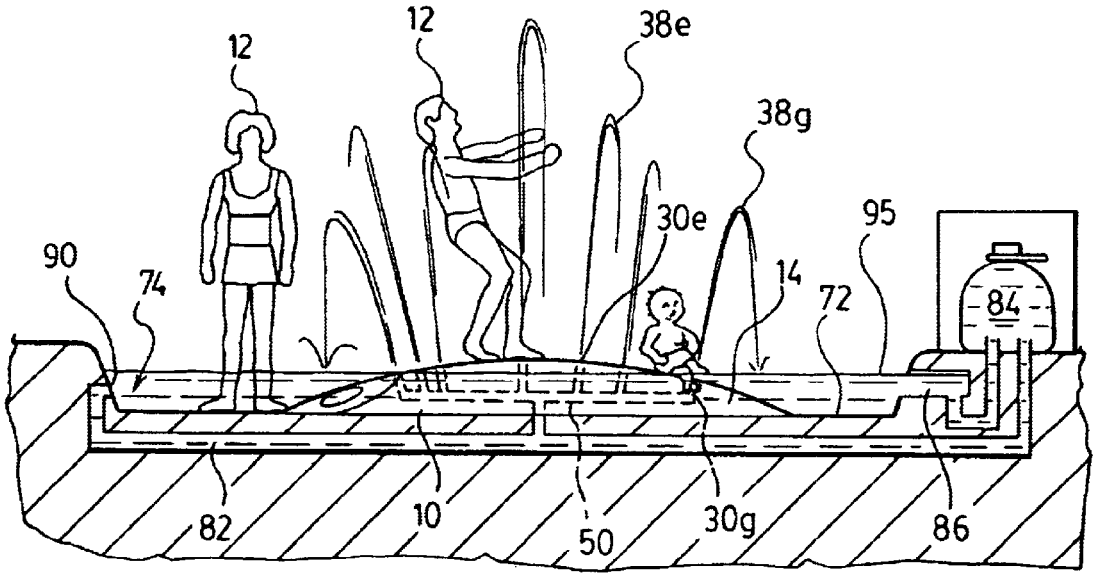
FIG. 6 illustrates a schematic side view of the fountain of FIG. 5 installed within a wading pool.

In FIGS. 5 and 6, the fountain 10 is provided with a fiberglass body 14 which has an upper surface 24 to which a coating having a non-slip texture has been applied. The fountain of FIG. 5 is manufactured off-site as a preformed structure adapted to be positioned in place on the bottom 72 of the swimming pool 74 with minimal disruption and/or modification to the existing swimming pool plumbing. The body 14 is shown in FIG. 5 as having formed therein the stylized image of a hippopotamus. Furthermore, a slide 76 is integrally formed in the body 14 portion extending from an uppermost central apex 78 to its peripheral edge 80.

As with the embodiment shown in FIG. 1, the fountain 10 includes a plurality of water nozzles 30*a*,30*b*,30*c*,30*d*,30*e*, 30*f*,30*g* which are recessed into the upper surface 24 of the body 14. The nozzles 30*a*–30*g* are interconnected to each other by a fountain pipe 50 disposed within the body 14. The fountain pipe 50 is provided in fluid communication with the main pool water conduit 82 which is used to recirculate water into the pool 24 following its purification by the filter 84. As a result, FIG. 6 shows the swimming pool filter 84 acting as the pressurized water source and operating to circulate water from a skimmer intake 86, and then back into the pool 74 through the pool water jets 90 and the fountain nozzles 30, via the conduit 82. It is to be appreciated that where the fountain 10 is disposed in the pool 74, water collection and recirculation may be performed solely through the pool filter 84, without the need for a separate water collection drain and/or recirculating pump.

The fountain 10 shown in FIGS. 5 and 6 enables participatory play by the users in the identical manner as that described with respect to the fountain shown in FIGS. 1 and 4.

Although FIG. 5 illustrates the fountain 10 as including a stylized graphic representation of a hippopotamus, the invention is not so limited. It is to be appreciated that representations of other animals and/or structures may also be used without departing from the spirit and scope of the invention.

FIGS. 5 and 6 show best the dome-shaped body 14 as extending a maximum height of about 30 cm and having a diameter of about 3 meters. Where the fountain is to be located in a partially submerged orientation in the wading pool 74, most preferably the fountain extends about 5 to 15 cm above the surface 95 of the water in the pool 74. Although not essential, each of the nozzles 30*a*,30*b*,30*c*, 30*d*,30*e*,30*f*,30*g* are also located on the upper surface 24 of the body 14 in positions selected so as to locate substantially above the water surface 95 when the fountain 10 and pool 74 are in normal use. This construction advantageously prevents sharply angling surfaces which, when wet, otherwise may result in a user 12 slipping whereby he or she otherwise could be injured.

Furthermore, while FIG. 5 illustrates the mound-shaped body 14 as incorporating an integral slide 76, the fountain 10 could also be provided with other water play elements, including without restriction the use of tipping buckets, water cannons or other water amusement devices.

Although FIGS. 5 and 6 illustrate the body 14 of the water fountain 10 as having a generally dome-shaped mound construction, the invention is not so limited. Numerous other fountain body shapes and/or sizes are also possible depending on the intended site of installation. Furthermore, the body 14 of the water fountain 10 could equally be provided as a raised platform of almost any configuration or for that matter recessed into the ground or underlying support structure with a flat upper surface positioned flush with the adjacent terrain.

Although FIG. 2 illustrates the fountain 10 as including a water circulation pump 42 as being disposed at a location remote from the fountain body 14, if desired the pump 42 could be incorporated directly within the body 14 to form the fountain as a more self-contained unit.

Although the preferred embodiment describes the body 14 of the fountain 10 as being preformed, the invention is not so limited. If desired, the body or support surface 14 could be fabricated directly on site, as for example by casting concrete or melted elastomeric material into the desired shape directly at the desired installation site.

Although FIG. 2 illustrates the fountain 10 as including a pressure relief valve 59 as relieving overpressure conditions in the conduit pipes 46,50, other mechanisms to relieve overpressure may also be used. For example, the electric pump 42 could be fitted with a stall-type motor which is adapted to stop pumping water when the water pressure on the outfeed side of the pump 42 exceeds a threshold valve.

While FIG. 2 discloses and illustrates the fountain 10 as having five water nozzles 30*a–e*, it is to be appreciated that the fountain could have more or fewer nozzles, depending on its overall size and the intended site of installation.

Although the detailed description describes and illustrates various preferred embodiments, the invention is not so limited. Many modifications and variations will now appear to a person skilled in the art. For a definition of the invention, reference may be had to the appended claims.

I claim:

1. A waterpark amusement device including a support structure having an upper surface sized to permit at least one user to stand or sit thereon, the support structure further having a structural integrity selected to support the at least one user in participatory water play in a position standing or sitting thereon, a plurality of water nozzles, each disposed substantially in said support structure and open to an outlet orifice formed in said upper surface, said outlet orifice having a size and shape selected to enable said orifice to be substantially blocked by a user's hand or foot, a pressurized water source, a water supply conduit providing fluid communication between said pressurized water source and said nozzles to permit water flow from said water source therealong and outwardly from said nozzles as a pressurized stream, the water supply conduit providing a fluid connection between said nozzles whereby the blockage of a first one of said nozzles by said user redirects said water flow to one or more other of said nozzles; and said support structure comprises a generally dome shaped mound having a maximum elevation selected at less than about 1 meter, and an average radial diameter selected at between about 1 and 4 meters.

2. The device of claim 1 wherein said support structure is supported by a bottom surface of a wading pool.

3. The device of claim 1 wherein said water supply conduit is disposed substantially beneath said upper surface of said support structure.

4. The device as claimed in claim 1 wherein said upper surface comprises an elastomeric material.

5. The device as claimed in claim 1 wherein said upper surface is provided with a non-slip coating or texture.

6. The device as claimed in claim 1 wherein said support structure is in the shape of a stylized animal.

7. The device as claimed in claim 1 further including a slide for supporting said users in sliding movement thereon.

8. An interactive waterpark fountain comprising, a pressurized water source, a support structure configured to support a plurality of users in participatory water play thereon, a plurality of water nozzles recessed substantially in said support structure, said nozzles each including an outlet orifice and being provided in fluid communication with said water source and each other, such that when said nozzles are unobstructed pressurized water flows from said water source and outwardly from the outlet orifice of each of said nozzle as a pressurized stream, and whereby the obstruction of the orifice of a first of said nozzle by a user to substantially prevent the flow of water therefrom redirects said water flow from one or more remaining unobstructed nozzles as a pressurized stream of greater intensity, a majority of said nozzles being disposed in said support structure in an orientation selected to direct the discharge streams emitted therefrom in a generally upward direction, and wherein said support structure comprises a generally dome shaped mound having a maximum elevation selected at less than about 1 meter, and an average radial diameter selected at between about 1 and 4 meters.

9. The fountain as claimed in claim 8 wherein said generally dome-shaped mound extends to a maximum height of less than about 0.5 meters.

10. The fountain as claimed in claim 8 further including a water conduit connecting said nozzles to said water source, said conduit disposed substantially within or beneath said support structure, said fountain further including valving for selectively controlling the flow of water from said water source.

11. The fountain as claimed in claim 10 further including a pressure relief mechanism provided in fluid communication with said conduit, said pressure relief mechanism being operable to divert at least some of said water flow from said nozzles upon a pressure of said water in said conduit exceeding a predetermined threshold pressure.

12. The fountain as claimed in claim 8 wherein said support structure is framed.

13. The fountain as claimed in claim 8 wherein said support structure further includes a non-slip upper surface.

14. In combination, a user interactive spray fountain, a wading pool for retaining a desired volume of water therein, and a pressurized water source, the spray fountain including, a support structure disposed in a partially submerged position in said pool and being configured to support a plurality of users standing thereon, a plurality of water nozzles disposed at least partially in said support structure, and a pressurized water source, a conduit providing fluid communication between said water source and said nozzles, said conduit further interconnecting said nozzles whereby when said nozzles are unobstructed water flows from said water source and outwardly from each of said nozzles as a discharge stream under a first pressure, and whereby the obstruction of one of said nozzles by a user's hand or foot to restrict the flow of water therefrom redirects said water flow to the remaining unobstructed nozzles as discharge streams of a second pressure greater than said first pressure, said nozzles being recessed into an upper surface of said support structure, so as not to interfere with said users standing thereon, a majority of said nozzles being disposed in an unsubmerged position of said support structure and oriented to direct the discharge streams emitted therefrom in a generally upward direction, and wherein said support structure comprises a generally dome shaped mound having a maximum elevation selected at less than about 1 meter, and an average radial diameter selected at between about 1 and 4 meters.

15. The combination as claimed in claim 14 wherein said pressurized water source comprises a pool filter and said conduit comprises a water pipe for recirculating water from the filter into the pool.

16. The combination as claimed in claim 14 wherein said fountain includes nozzles of differing configurations selected to emit discharge streams having different water spray patterns.

17. The combination as claimed in claim 14 further including a recirculation system for collecting and recirculating water discharged from the nozzles to the pressurized water source.

* * * * *